US011162266B2

(12) United States Patent
Bunch et al.

(10) Patent No.: US 11,162,266 B2
(45) Date of Patent: Nov. 2, 2021

(54) DEVICE FOR LEVELING AND ALIGNING TILES AND METHOD FOR LEVELING AND ALIGNING TILES

(71) Applicants: Clinton D. Bunch, Keller, TX (US); Joshua A. Bunch, Keller, TX (US)

(72) Inventors: Clinton D. Bunch, Keller, TX (US); Joshua A. Bunch, Keller, TX (US)

( * ) Notice: Subject to any disclaimer, the term of this patent is extended or adjusted under 35 U.S.C. 154(b) by 0 days.

(21) Appl. No.: 16/685,036

(22) Filed: Nov. 15, 2019

(65) Prior Publication Data

US 2020/0080323 A1 Mar. 12, 2020

Related U.S. Application Data

(63) Continuation of application No. 16/102,344, filed on Aug. 13, 2018, now Pat. No. 10,704,274, which is a continuation of application No. 15/345,802, filed on Nov. 8, 2016, now Pat. No. 10,047,530, which is a continuation of application No. 15/044,907, filed on Feb. 16, 2016, now Pat. No. 9,487,959, which is a (Continued)

(51) Int. Cl.

| | |
|---|---|
| ***E04F 21/20*** | (2006.01) |
| ***E04F 21/22*** | (2006.01) |
| ***E04F 21/18*** | (2006.01) |
| ***E04F 21/00*** | (2006.01) |
| *E04F 13/08* | (2006.01) |
| *E04F 15/02* | (2006.01) |

(52) U.S. Cl.

CPC ..... *E04F 21/20* (2013.01); *E04F 21/0092* (2013.01); *E04F 21/1844* (2013.01); *E04F 21/1877* (2013.01); *E04F 21/22* (2013.01); *E04F 13/0892* (2013.01); *E04F 15/02005* (2013.01)

(58) Field of Classification Search

CPC ... E04F 21/0092; E04F 21/22; E04F 21/1844; E04F 21/1877; E04F 13/0892; E04F 15/02005

See application file for complete search history.

(56) References Cited

U.S. PATENT DOCUMENTS

| | | | |
|---|---|---|---|
| 4,397,125 | A | 8/1983 | Gussler |
| 7,603,825 | B2 | 10/2009 | Dohren |

(Continued)

FOREIGN PATENT DOCUMENTS

| | | |
|---|---|---|
| AU | 2012101175 | 8/2012 |
| WO | 201303376 | 3/2013 |

OTHER PUBLICATIONS

Pearl Abrasive Co., Tuscan Leveling System, www.pearlabrasive.com.

(Continued)

*Primary Examiner* — Babajide A Demuren

(74) *Attorney, Agent, or Firm* — Scott Griggs; Griggs Bergen LLP

(57) ABSTRACT

A device for leveling and aligning tiles and method for leveling and aligning tiles are disclosed. In one embodiment, the leveling device includes a body and two spaced and parallel strip members extending transversely from the body. Each of the spaced and parallel strip members extend to the front and rear of the body. Two opposing lateral open windows are formed in the body. A breakaway section is defined along the body. A wedge device is provided for penetrating one or more of the two opposing lateral open windows and exerting a force on the tiles for leveling them relative to each other.

19 Claims, 7 Drawing Sheets

Related U.S. Application Data continuation-in-part of application No. 13/859,316, filed on Apr. 9, 2013, now Pat. No. 9,260,872.

(56) References Cited

U.S. PATENT DOCUMENTS

| | | | |
|---|---|---|---|
| 7,621,100 | B2 | 11/2009 | Kufner et al. |
| D630,077 | S | 1/2011 | Kufner |
| 7,861,487 | B2 | 1/2011 | Kufner et al. |
| 7,954,300 | B1 | 6/2011 | Kufner et al. |
| 7,992,354 | B2 | 8/2011 | Doda, Jr. |
| 8,079,199 | B1 | 12/2011 | Kufner |
| 8,181,420 | B2 | 5/2012 | Torrents I Comas |
| 8,429,878 | B1 | 4/2013 | Hoffman |
| 9,045,911 | B2 | 6/2015 | Hoffman |
| D734,119 | S | 7/2015 | Kufner |
| 9,260,872 | B2 | 2/2016 | Bunch et al. |
| 9,464,448 | B2 | 10/2016 | Hoffman |
| 9,487,959 | B2 | 11/2016 | Bunch et al. |
| 9,657,485 | B2 | 5/2017 | Meyers |
| 10,047,530 | B2 | 8/2018 | Bunch et al. |
| 10,208,491 | B2 | 2/2019 | Bunch et al. |
| 2008/0236094 | A1 | 10/2008 | Doda |
| 2010/0263304 | A1 | 10/2010 | Torrents I Comas |
| 2012/0144773 | A1 | 6/2012 | Mauro |
| 2013/0055675 | A1 | 3/2013 | Sighinolfi |
| 2013/0118115 | A1 | 5/2013 | Hoffman et al. |
| 2013/0247508 | A1 | 9/2013 | Hoffman |
| 2013/0255182 | A1 | 10/2013 | Kufner |
| 2014/0033640 | A1 | 2/2014 | Gorton |
| 2014/0116001 | A1 | 5/2014 | Ghelfi |
| 2014/0325936 | A1 | 11/2014 | Psaila |
| 2015/0308130 | A1 | 10/2015 | Biec |
| 2018/0100315 | A1 | 4/2018 | Volponi |
| 2018/0347210 | A1 | 12/2018 | Bunch et al. |
| 2018/0355622 | A1 | 12/2018 | Bunch et al. |
| 2019/0177986 | A1 | 6/2019 | Bunch et al. |

OTHER PUBLICATIONS

Q.E.P. Co., Inc., Lash Tile Leveling Clips and Wedges, 99720/9972, www.qep.com.

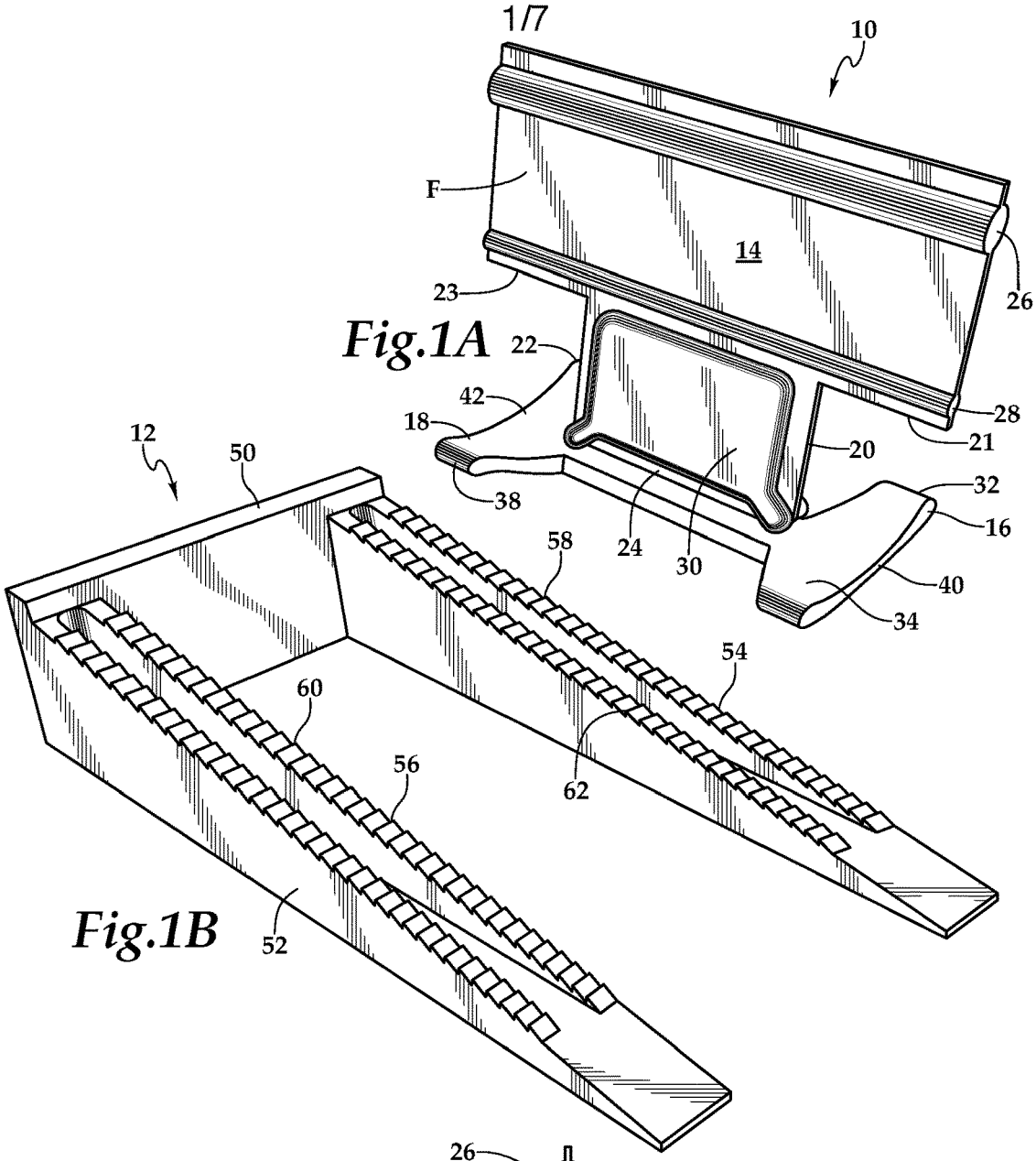
Fig.1A
Fig.1B
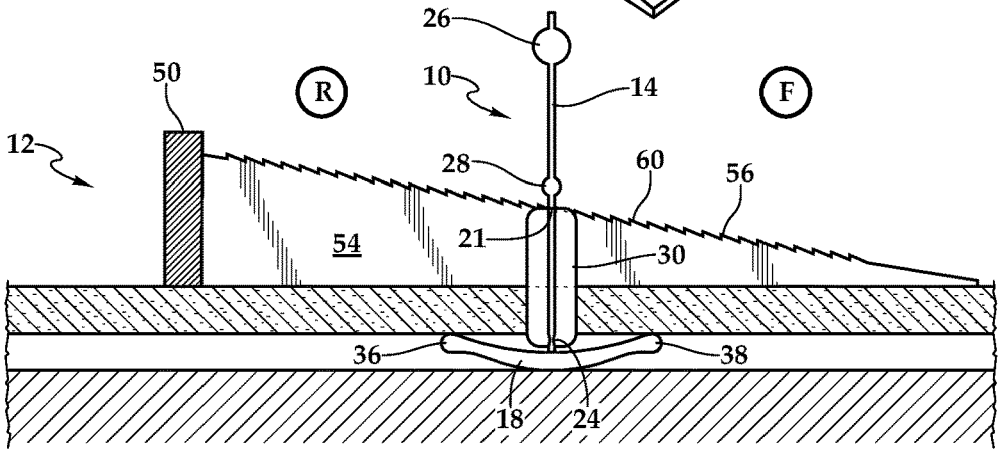
Fig.2

R
F
10
90
94
30
70
88
72
S
18
24
92
M 50
12
10
52
94
30
90
72
70
S
18
24
92
M
88

10
12
94
30
90
52
50
72
70
S
18
24
92
M
88

10

90
30
70
S
18
M
88

DEVICE FOR LEVELING AND ALIGNING TILES AND METHOD FOR LEVELING AND ALIGNING TILES

PRIORITY STATEMENT & CROSS-REFERENCE TO RELATED APPLICATIONS

This application is a continuation of co-pending U.S. patent application Ser. No. 16/102,344 entitled "Device for Leveling and Aligning Tiles and Method for Leveling and Aligning Tiles" filed on Aug. 13, 2018, in the names of Clinton D. Bunch et al.; which is a continuation of U.S. patent application Ser. No. 15/345,802 entitled "Device for Leveling and Aligning Tiles and Method for Leveling and Aligning Tiles" filed on Nov. 8, 2016, in the names of Clinton D. Bunch et al., and issued on Aug. 14, 2018 as U.S. Pat. No. 10,047,530; which is a continuation of U.S. patent application Ser. No. 15/044,907 entitled "Device for Leveling and Aligning Tiles and Method for Leveling and Aligning Tiles" filed on Feb. 16, 2016, in the names of Clinton D. Bunch et al., and issued on Nov. 8, 2016 as U.S. Pat. No. 9,487,959; which is a continuation-in-part of U.S. patent application Ser. No. 13/859,316 entitled "Device for Leveling and Aligning Tile and Method for Leveling and Aligning Tiles" filed on Apr. 9, 2013, in the names of Clinton D. Bunch and Joshua A. Bunch, and issued on Feb. 16, 2016 as U.S. Pat. No. 9,260,872; all of which are hereby incorporated by reference, in entirety, for all purposes.

This application contains subject matter related to U.S. patent application Ser. No. 16/102,207 entitled "Device for Leveling and Aligning Tiles and Method for Leveling and Aligning Tiles" filed on Aug. 13, 2018, in the names of Clinton D. Bunch et al.; which is hereby incorporated by reference, in entirety, for all purposes.

TECHNICAL FIELD OF THE INVENTION

This invention relates, in general, to tile installation and, in particular to a device for leveling and aligning tiles and properly spacing tiles during the installation thereof.

BACKGROUND OF THE INVENTION

Tile has become a popular decorative and functional article for use in floors, walls, countertops, and the like. Both professional tile installers and do-it-yourselfers spend a great deal of time aligning and leveling tiles as they are being placed on a substrate's surface. Proper alignment and leveling of each tile is important for a number of reasons. Improper installation can cause the need for tiles to be replaced in order to prevent a spacing error from propagating across the substrate, aesthetic reasons, and in some instances, safety concerns. A need exists for a device for leveling and aligning tiles and properly spacing tiles.

SUMMARY OF THE INVENTION

It would be advantageous to achieve a device for leveling and aligning tiles and properly spacing tiles. It would also be desirable to enable a mechanical-based solution that furnishes an inexpensive tool that assists professional tile installers and do-it-yourselfers. To better address one or more of these concerns, in one aspect of the invention, a tile leveling device and a wedge device for use with tiles are disclosed. In one embodiment, the leveling device includes a body and two spaced and parallel strip members extending transversely from the body. Each of the spaced and parallel strip members extend to the front and rear of the body. Two opposing lateral open windows are formed in the body. A breakaway section is defined along the body.

In one implementation, a wedge device includes a backstop member and a pair of members extending from the backstop member. Each of pair of members includes a tapered surface configured to penetrate the lateral open windows and exerting force against tiles, thereby pressing the tiles against the first and second strip members in order to level and align.

In another embodiment, the leveling device includes an inverted U-shaped body with an I-shaped base orthogonally coupled thereto. An open window is located within the U-shaped body between stems thereof. The I-shaped base has four bars extending transversely from the inverted U-shaped body and that extend upwards toward the inverted U-shaped body in an arcuate fashion to define respective four points of contact for two, three, and four tiles. Two breakaway sections are respectively defined along the spaced stems of the inverted U-shaped body at the I-shaped bar. In another implementation, a wedge device includes an oversized backstop member and a wedge member extending from the oversized backstop member. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which:

FIGS. 1A and 1B are front perspective views of one embodiment of a leveling device with a wedge device according to the teachings presented herein;

FIG. 2 is a side view, in partial cross-section, of the leveling device with the wedge device presented in FIGS. 1A and 1B;

DETAILED DESCRIPTION OF THE INVENTION

Figure 5:
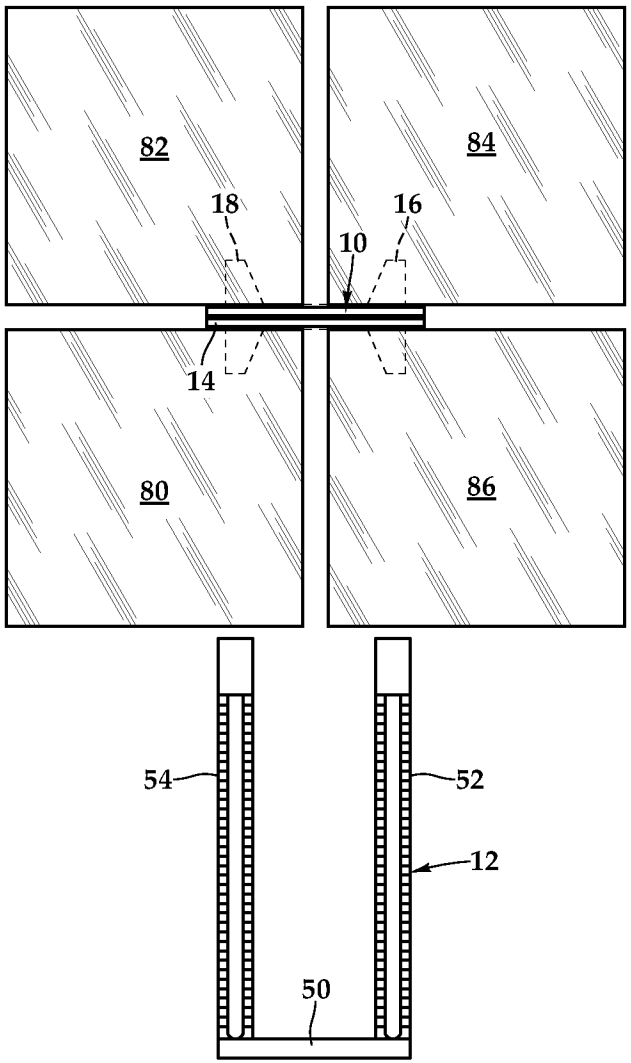
FIGS. 3 through 5 are top plan views showing installations of two, three, and four tile using the leveling device and wedge device presented in FIGS. 1A, 1B, and 2.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Referring initially to FIGS. 1A, 1B, and 2, therein is depicted one embodiment of a tile leveling device that is schematically illustrated and generally designated 10. The tile leveling device 10 and a wedge device 12 are utilized, in combination, to align and level two, three, or four tiles, for example. The leveling device 10 includes a body 14 and spaced and parallel strip members 16, 18 extending transversely from the body 14. Each of the spaced and parallel strip members 16, 18 extend to the front F and rear R of the body 14. Lateral open windows 20, 22 having upper edges 21, 23 are formed in the body 14 and sized to accept a member having a tapered surface configured to penetrate the respective lateral open windows 20, 22 and exert force thereunder. A breakaway section 24 is defined along the body 14. The breakaway section 24 may be a frangible section of the body 14 of reduced thickness that would promote the breakaway, and thus, separation of the body 14. An upper bump 26 and a lower bump 28 extend horizontally across the body 14. The upper bump 26 being larger and more pronounced to provide lifting power. A spacing pad 30 is integral with the body 14 and may vary in thickness depending on the application. The spacing pad 30 contributes to furnishing a combination of vertical leveling and joint spacing within a single product. Moreover, the spacing pad 30, which may be more generally a spacer, is configured to position the tiles a predetermined distance apart depending on the application.

The spaced and parallel strip members 16, 18 provide four points of contact 32, 34, 36, 38 for lift of tiles, while still establishing space for maximum mortar penetration between the spaced and parallel strip members 16, 18. As shown, the spaced and parallel strip members 16, have an arcuate form wherein the spaced and parallel strip members 16, 18 curve upwards from the junction with the body 14 to the four points of contact 32, 34, 36, 38. That is, the spaced and parallel strip members 16, 18 define convex curvatures 40, 42 that are flexible and compressible for tile installation during a leveling and alignment of a tile. The convex curvatures 40, 42 also ensure that tiles of varying thicknesses may be leveled and aligned. In fact, in the corner embodiment, four tiles having four varying thicknesses may be leveled and aligned by way of the flexibility and compressibility of the convex curvatures 40, 42 of the strip members 16, 18.

The wedge device 12 includes a backstop member 50 and two extension members, depicted as wedge members 52, 54 extending from the backstop member 50. The backstop member provides a push area for fingers or a thumb and an enhanced sized that furnishes more leverage during use. Each of the wedge members 52, 54 include respective tapered surfaces 56, 58 configured to penetrate the lateral open windows 20, 22 and exert force against the tiles by pressing the tiles against the strip members 16, 18. Teeth 60, 62 are located along the tapered surfaces 56, 58 in order to latch onto the respective upper edges 21, 23 of the opposing lateral open windows 20, 22. In operation, the teeth 60, 62 prevent the respective wedge members 52, 54 from slipping out of the lateral open windows 20, 22 during penetration thereof. As will be appreciated, the wedge device 12 may penetrate the leveling device from the front F or rear R.

Figure 4:
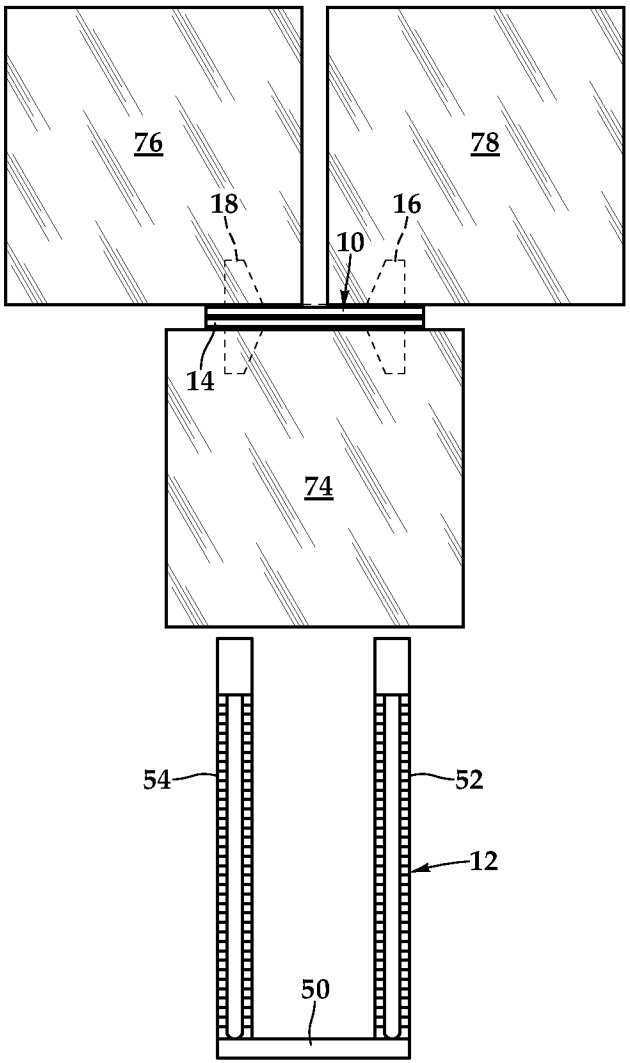
Figure 3:
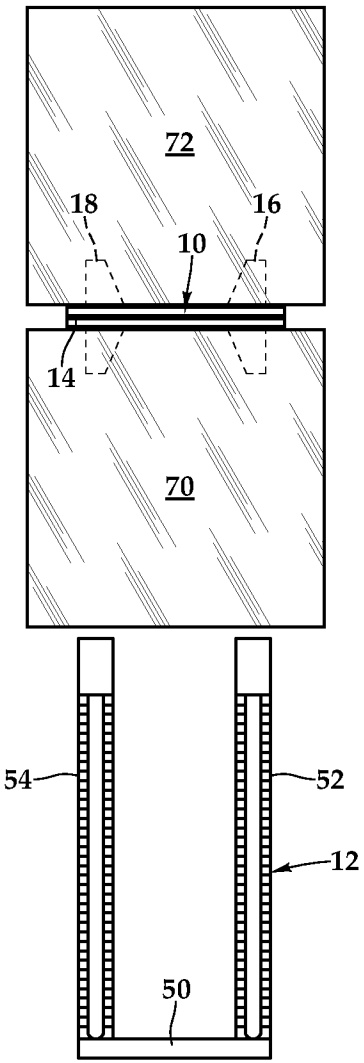
Figure 6:
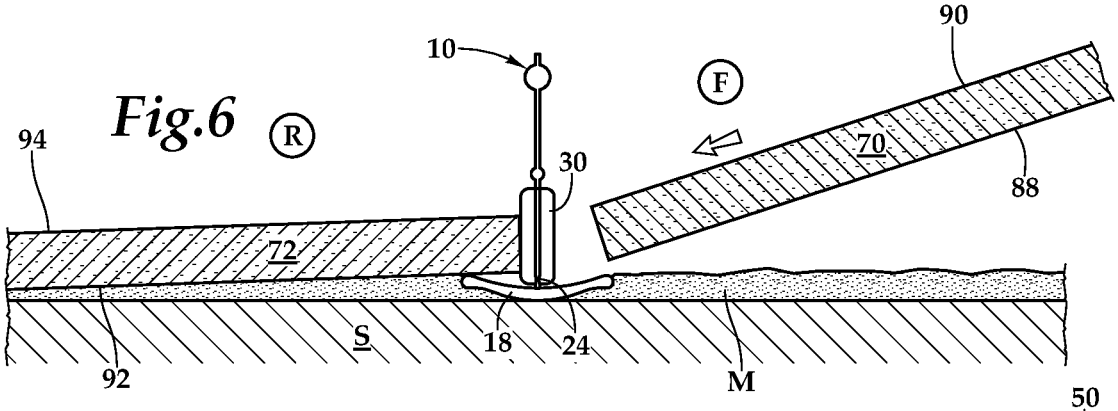
FIGS. 6 through 8 are side cross-sectional views of one embodiment of the installation of tile on a floor using the leveling device and wedge device presented in FIGS. 1A, 1B, and 2.
Figure 7:
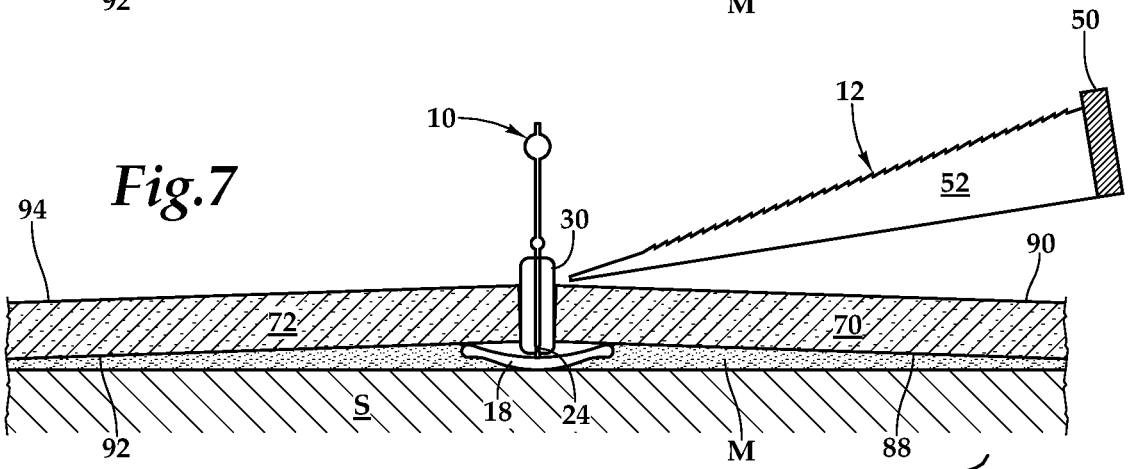

Referring now to FIGS. 3 through 5, the tile leveling device may be utilized with two tiles 70, 72 (FIG. 3), three tiles (FIG. 4) 74, 76, 78, or four tiles 80, 82, 84, 86 (FIG. 5) for installation on a substrate, subsurface, or other surface, which is indicated by the letter S. By way of example, in the two tile installation, the tile 70 is positioned over the front portions of the strip members 16, 18. The tile 70 has a lower surface 88 opposite an upper surface 90, wherein the lower surface 88 faces the strip members 16, 18 and the subsurface S. The upper surface 90 is farther from the strip members 16, 18 than the lower surface 88 and faces away from the strip members 16, 18. The second tile 72 is similarly situated over the rear portions of the strip members 16, 18 and includes a lower surface 92 and an upper surface 94.

Accordingly, a single leveling device 10 and wedge device 12 may be utilized to install, align, and level between two and four tiles. The use of the wedge device 12 having two extension members and the two lateral open windows 20, 22 provide for utilization at corner tiles; thereby offering improved efficiency. More particularly, using one leveling device for a corner improves efficiency and minimizes the number of leveling devices required to complete a job. Additionally, as previously discussed, the arcuate portions of the parallel strip members 16, 18 compress and flatten to accommodate different thicknesses of tiles to provide a level surface. In fact, the leveling device and wedge device presented herein may simultaneously accommodate between two and four different thicknesses of tiles.

Referring now to FIGS. 6 through 9, one example of installation is shown wherein the tile leveling device 10 is placed such that one end of the tile 72 sits on the rear portions of the parallel strip members 16, 18 and the tile abuts the body 14 of the leveling device. Such an installation methodology may be used for any of the configurations shown in FIGS. 3 through 5, for example. By way of illustration, therefore, this example is for the two tile application of FIG. 3. The adjacent tile 70 sits on the other side of the body 14 and across the front portions of the parallel strip members 16, 18. The extension members, namely wedge members 52, 54 of the wedge device 12 are then inserted in the respective lateral open windows 20, 22. The backstop member 50 is then pushed, thereby driving the wedge members 52, 54 to penetrate the respective lateral open windows 20, 22.

Figure 8:
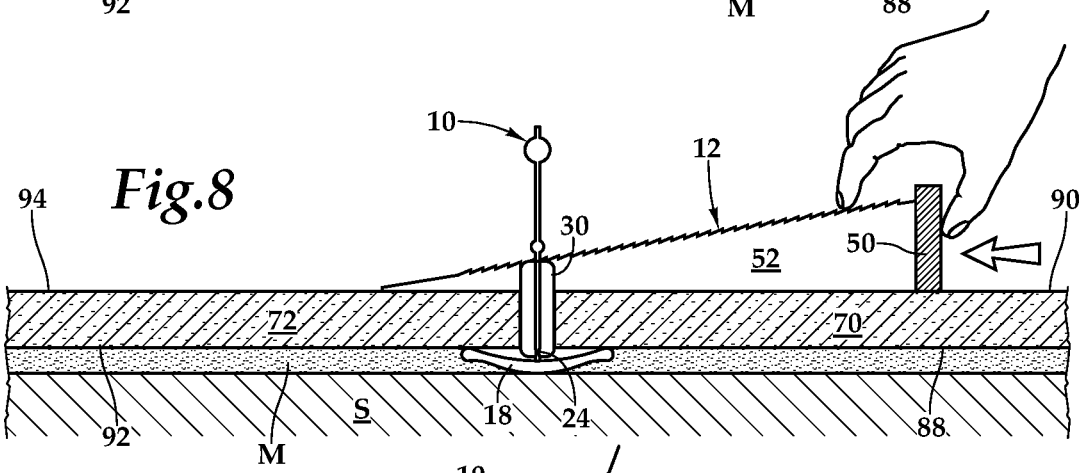

In one embodiment, the wedge device 12 offers an advantage over individual wedges as the backstop member 50 provides a wider or broader surface to push. In particular, as shown in FIG. 8, a thumb or finger may be used to drive the wedge device 12 into the leveling device 10. The ease of push advantage translates into a more powerful lift because of the more even distribution of the lifting surface. Therefore, the leveling device 10 and wedge device 12 combination provide improved performance, both quantitatively and qualitatively. With respect to the former, the lateral open windows 20, 22 in combination with the wedge device 12 permit use at corners increasing efficiency and reducing the number of leveling and aligning operations, which leads to faster installation using fewer leveling devices. With respect to the latter, the improved contact surface provided by the backstop member 50 minimizes the stress and strain on the fingers and thumbs.

Additionally, the design of the wedge device 12 discourages the tiles from pivoting by providing two points of contact with each tile edge. By way of example, on a 12 inch by 12 inch tile, a traditional installation system would require two spacers for each side, for a total of eight spacers, in order to stabilize the edges and prevent pivoting. Using the teachings presented herein, four leveling devices 10 may be used and the optimal eight points of contact would be maintained.

Figure 9:
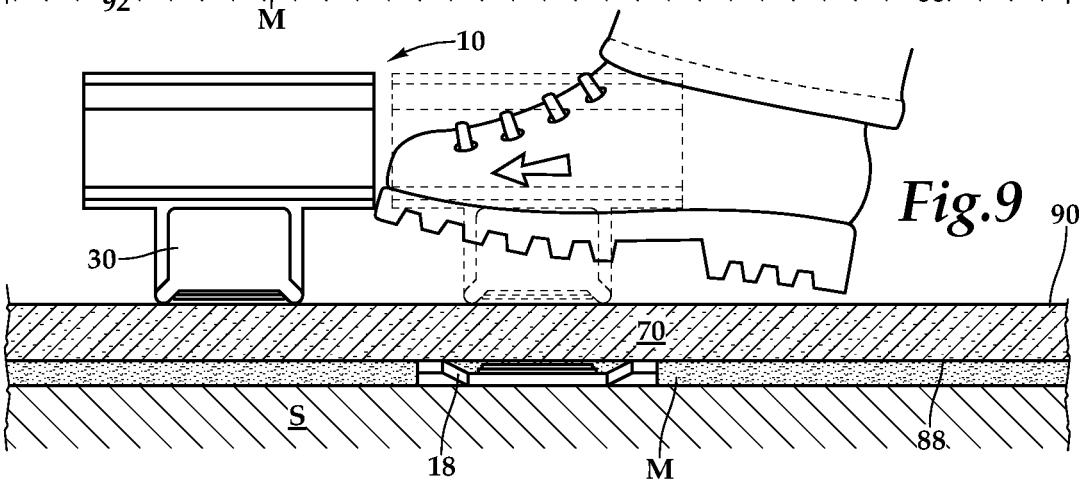
FIG. 9 is a front cross-sectional view of the embodiment of the installation of tile on a floor or subsurface using the leveling device and wedge device presented in FIGS. 1A, 1B, and 2.

Continuing with the description of FIGS. 6 through 9, in one implementation, as these wedge-shaped extension members are continually pushed through the lateral open windows 20, 22 due to the increasing thickness of the wedge members 52, 54, the action causes the lower surfaces 88, 92 of each of the tiles 70, 72 to be compressed downward pressing the strip members 16, 18 beneath the tiles 70, 72 toward the subsurface S, on which is located mortar M for bonding the tiles 70, 72 to the subsurface S. As a result, the tiles 70, 72 are aligned and leveled. The spacing between the tiles is controlled by the thickness of the body and, in one embodiment, the presence of the spacing pad 30, which may more generally be a spacer. Once the tiles 70, 72 are set, the wedge device 12 may be removed and the body 14 is broken off by kicking or applying force to the side of the wedge device 12 such that the body 14 is severed at the breakaway section 24. As shown in FIG. 9, the application of force by a boot, breaks the body at a break at the breakaway section 24. In the illustrated implementation, the breakaway section 24 is positioned such that it is located between the surfaces 88, 90, 92, 94 of the tiles 70, 72. That is, the breakaway section 24 is located at a height within the thickness of the installed tiles. In this position, the breakaway section 24 is not exposed to any adhesive that may be used to adhere the tiles to the subsurface S, which may be a floor or wall, for example.

Figure 10:
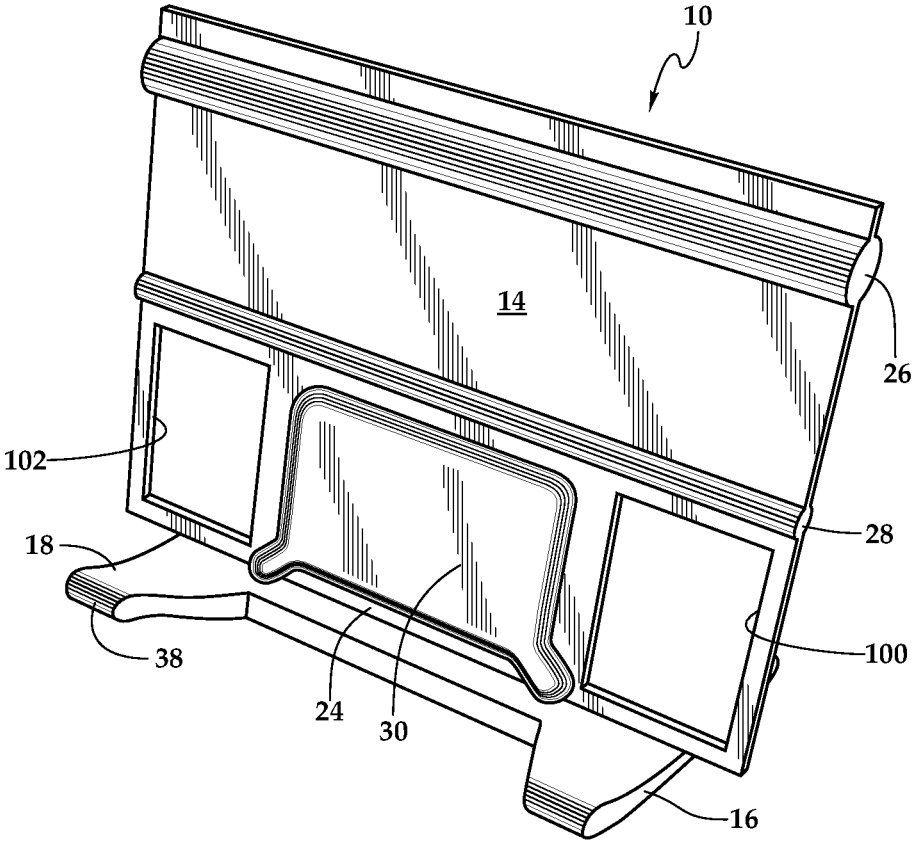
FIG. 10 is a front perspective view of another embodiment of a leveling device according to the teachings presented herein.

Referring now to FIG. 10, an alternative embodiment of the tile leveling device 10 includes the body and the spaced and parallel strip members 16, 18 extending transversely from the body 14. In this embodiment, opposing lateral closed windows 100, 102 are formed in the body 14 with each of the opposing lateral closed windows 100, 102 sized to accept a wedge device having wedge members including a tapered surface configured to penetrate the respective lateral closed windows 100, 102 and exert force against multiple tiles pressing the tiles against the strip members 16, 18. Additionally, the breakaway section 24 is defined along the body 14. By way of further example, a further embodiment is possible, wherein the leveling device 10 would include a lateral open window and a lateral closed window.

Figure 11A:
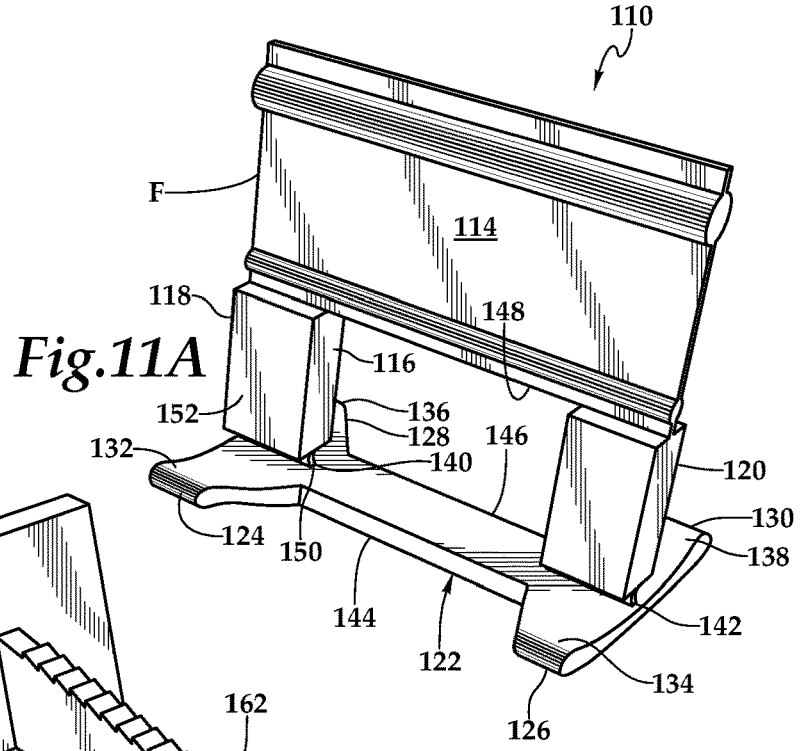
FIGS. 11A and 11B are front perspective views of one embodiment of a leveling device with a wedge device according to the teachings presented herein.
Figure 11B:
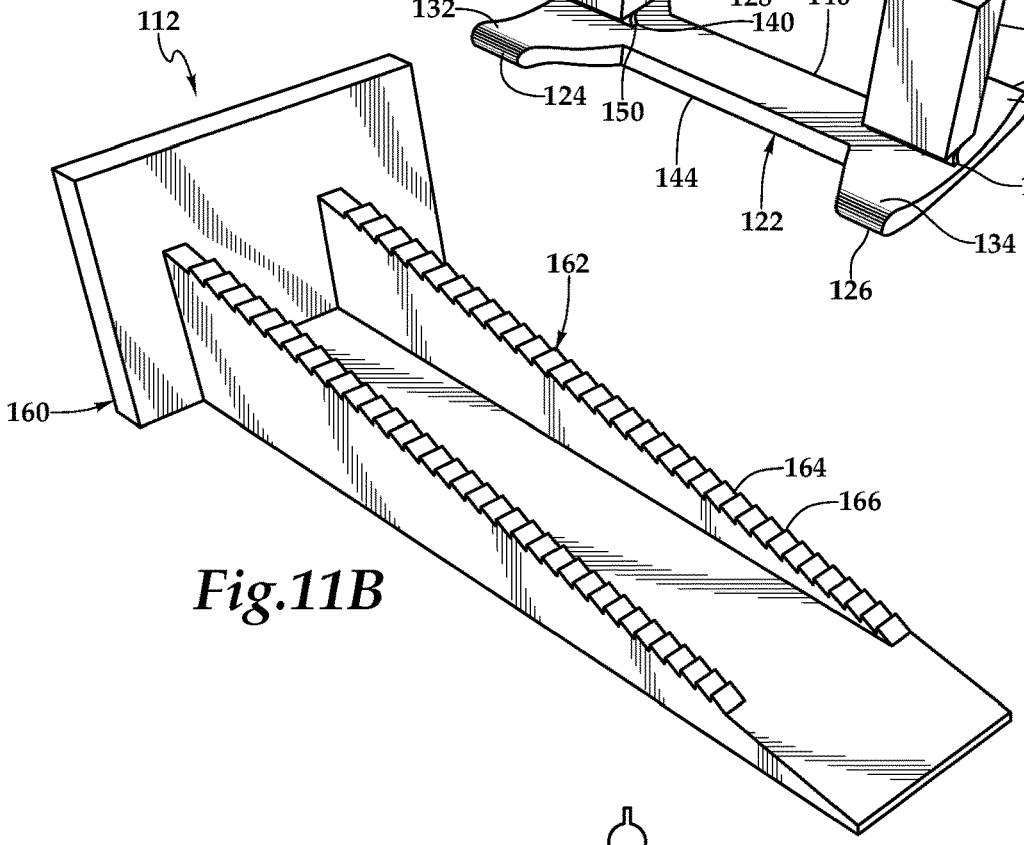
Figure 12:
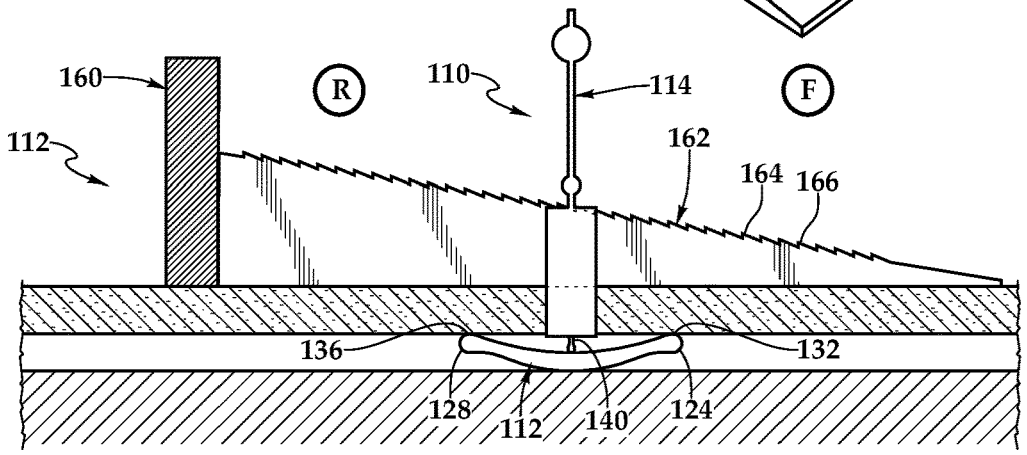
FIG. 12 is a side view, in partial cross-section, of the leveling device with the wedge device presented in FIGS. 11A and 11B.

Referring to FIGS. 11A, 11B, and 12, in one embodiment of a tile leveling device 110 and tile combination with a wedge device 112, the tile leveling device 110 includes an inverted U-shaped body 114 defining an open window 116 between two stems 118, 120 of the inverted U-shaped body 114. An I-shaped base 122 is orthogonally coupled to the inverted U-shaped body 114 such that four spaced bars 124, 126, 128, 130 extend transversely from the inverted U-shaped body 114. In particular, the spaced bars 124, 126 extend to the front F of the inverted U-shaped body 114 and the spaced bars 128, 130 extend to the rear R of the inverted U-shaped body 114. Each of the bars 124, 126, 128, 130 extends upward toward the inverted U-shaped body in an arcuate fashion to define respective four points of contact 132, 134, 136, 138 for two, three, and four tiles.

Two breakaway sections 140, 142 are defined along the respective two stems 118, 120 of the inverted U-shaped body 114. Additionally, as shown, a notch 144 is formed between the bars 124, 126 and a notch 146 is formed between the bars 128, 130. The open window 116 includes an upper edge 148. An open span 150 is proximally interposed between the breakaway sections 140, 142 and the open span 150 forms a portion of the open window 116. Spacing pads, such as spacing pad 152, may be utilized to position the tiles a predetermined distance apart, depending on the application.

The wedge device 112 includes an oversized backstop member 160. A wedge member 162 extends from the oversized backstop member 160 and includes a tapered surface 164 that is configured to penetrate the open window 116 and exert force against two, three, or four tiles pressing the tiles against the bars 124, 126, 128, 130. The breakaway sections 140, 142 are located where the ends of the stems 118, 120 of the inverted U-shaped body 114 contact the I-shaped base 122. Teeth 166 are positioned along the tapered surface 164 in order to latch onto the upper edge 148 of the open window 116.

In operation, the leveling device 110 may be used to align two, three or four tiles and operation is similar to leveling device 10 and wedge device 12, as previously presented. Similar to the leveling device presented in FIG. 5, in a four-tile embodiment, each tile has corner-to-subfloor contact due to the notches that provide space for mortar contact therein. Similarly, in a two-tile implementation, for example, each tile has edge-to-subfloor contact due to the notches. More particularly, the tapered surface 164 penetrates the open window 116 contacting the upper edge 148 thereof and exerting force against both tiles pressing the tiles against the bars 124, 126, 128, 130, wherein breakaway sections 140, 142 are located beyond the undersurfaces of the tiles in a direction away from the bars 124, 126, 128, 130. As previously discussed, the arcuate portions of the parallel strip members compress and flatten to accommodate different thicknesses of tiles to provide a level surface. In fact, the leveling device and wedge device presented herein may simultaneously accommodate between two and four different thicknesses of tiles.

Figure 13:
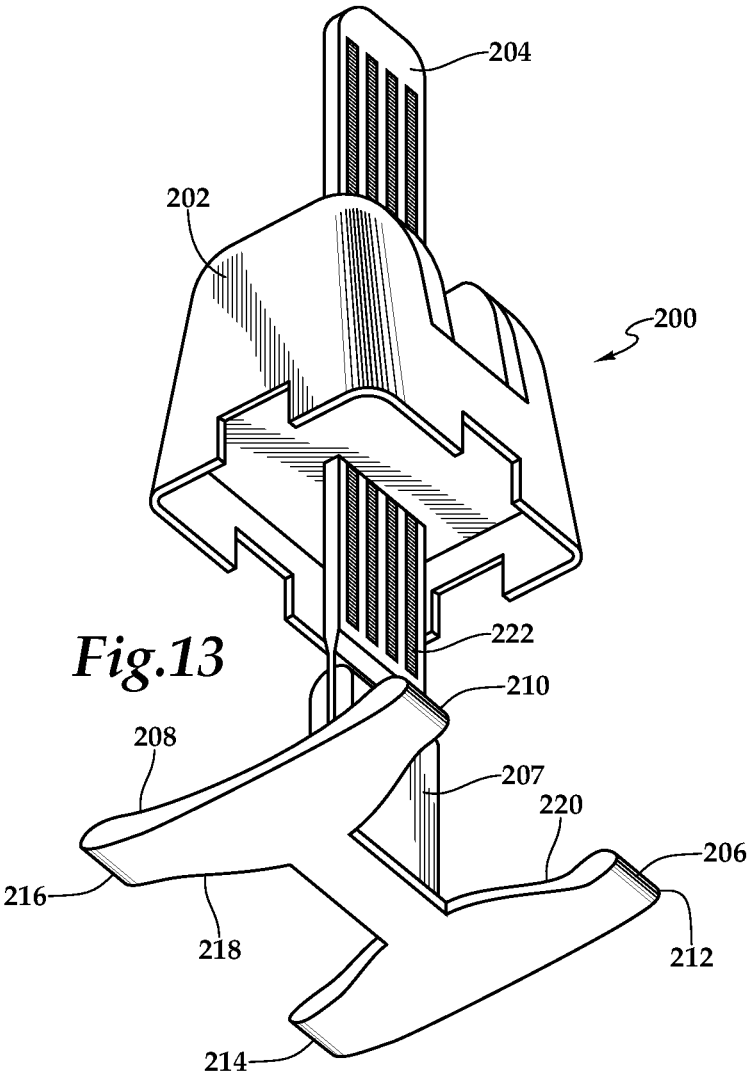
FIG. 13 is a front perspective view of an alternate embodiment of a leveling device.
Figure 14:
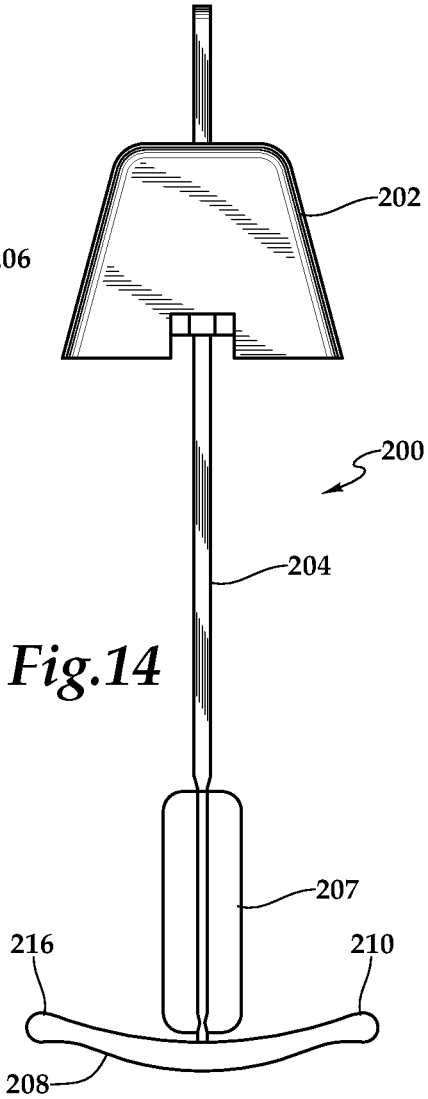
FIG. 14 is a side elevation view of the alternative embodiment of the leveling device depicted in FIG. 13.

Referring now to FIGS. 13 and 14, a tile leveling device 200 for use with a locking subassembly 202 are presented. As shown, the tile leveling device includes a shaft 204 and spaced and parallel strip members 206, 208 extend transversely from the shaft 204. The locking subassembly 202 is configured to traverse the shaft and exert force against the tiles by pressing the tiles against the parallel strip members, similar to the functionality described in previous embodiments. Each of the spaced and parallel strip members extend to the front and rear of the shaft 204. As shown, a frangible breakaway section is defined along the shaft 204. A spacing pad 207, which may be similar to spacing pad 30, may be integral with the shaft 204 and may vary in thickness depending on the application. The spaced and parallel strip members 206, 208 provide four points of contact 210, 212, 214, 216 for lift of tiles, while still establishing space for maximum mortar penetration between the spaced and parallel strip members 206, 208. Convex curvatures 218, 220 ensure that the tiles of varying thicknesses may be leveled and aligned, including the alignment of up to four tiles of varying thickness.

In operation, once the tiles are properly positioned, the locking subassembly 202 is secured in its place above the tiles and prevented from moving along the shaft 204 before being driven down to compress the tiles. The shaft 204 may include a locking surface 222, such as a "zip tie" to enable movement along the shaft 204 by the locking subassembly 202 in only one direction, i.e., toward the tiles.

Figure 15:
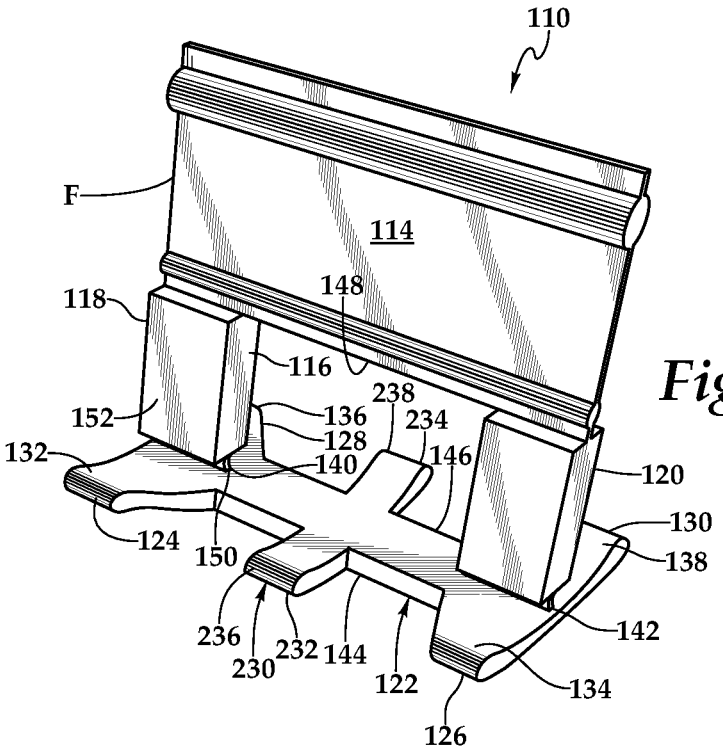
FIG. 15 is a front perspective view of a further alternate embodiment of a leveling device.
Figure 16:
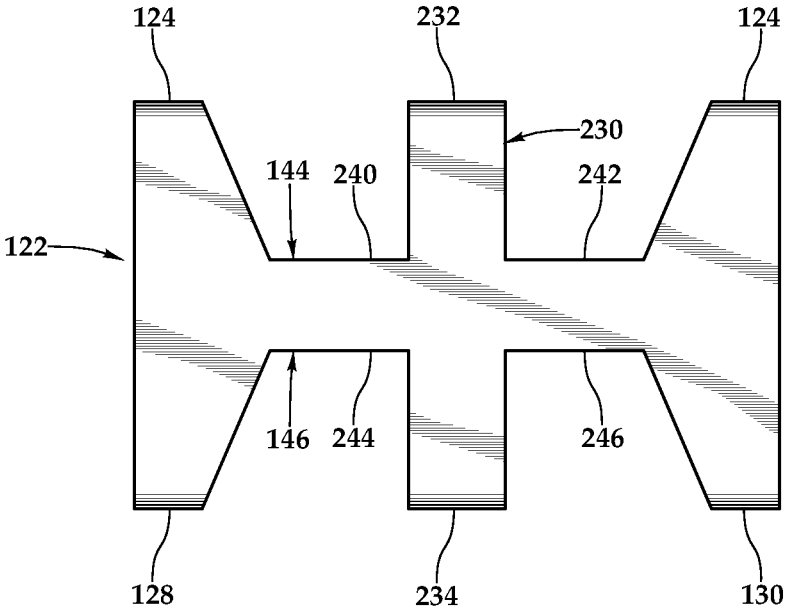
FIG. 16 is a bottom plan view of the leveling device depicted in FIG. 15.

Referring to FIGS. 15 and 16, in one further embodiment of the tile leveling device 110 and tile combination with the wedge device 112, the tile leveling device 110 includes the inverted U-shaped body 114 defining the open window 116 between two stems 118, 120 of the inverted U-shaped body 114. The I-shaped base 122 is orthogonally coupled to the inverted U-shaped body 114 such that four spaced bars 124, 126, 128, 130 extend transversely from the inverted U-shaped body 114. In particular, the spaced bars 124, 126 extend to the front F of the inverted U-shaped body 114 and the spaced bars 128, 130 extend to the rear R of the inverted U-shaped body 114. Each of the bars 124, 126, 128, 130 extends upward toward the inverted U-shaped body in an arcuate fashion to define respective four points of contact 132, 134, 136, 138 for two, three, and four tiles.

As shown, the I-shaped base is intersected by a crossbar 230, which is located between the bars 124, 126 and the bars 128, 130. The crossbar 230 may take any shape or form and may be considered a bi-directional projection, for example. As illustrated, the crossbar 230 includes a bar 232 extending to the front F of the inverted U-shaped body 114 and a bar 234 extends to the rear R of the inverted U-shaped body 114. The bars 232, 234 may have outwardly extending arcuate portions 236, 238 at the respective ends that compress and flatten to accommodate the thickness. Moreover the bars 232, 234 may be substantially equal to the length of the bars 124, 126, 128, 130. In another embodiment, the bars 232, 234 may be greater than or less than the length of the bars 124, 126, 128, 130.

Two breakaway sections 140, 142 are defined along the respective two stems 118, 120 of the inverted U-shaped body 114. Additionally, as shown, the notch 144 is formed between the bars 124, 126 and the notch 146 is formed between the bars 128, 130. The open window 116 includes an upper edge 148. The open span 150 is proximally interposed between the breakaway sections 140, 142 and the open span 150 forms a portion of the open window 116. As shown, the crossbar 230 intersects the notch 144 forming subnotches 240, 242 between the bars 124, 126 and the crossbar 230. Similarly, subnotches 244, 246 are formed between the bars 128, 130 and the crossbar 230. It should be appreciated that although the I-shaped base 122 with the crossbar 230 is depicted with a particular U-shaped body 114, it should be appreciated that the I-shaped base 122 with the crossbar 230 may be utilized with any of the leveling devices 10 presented herein, including the leveling devices 10 of FIG. 1A, FIG. 10, FIG. 13, and FIG. 14, for example.

The order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A tile leveling device comprising:

a leveling device comprising:

an integral one piece, one plane body defining first and second windows within the integral one piece, one plane body, a base coupled to the integral one piece, one plane body by a base to body coupling, the base extending to the front of the integral one piece, one plane body and the base extending to the rear of the integral one piece, one plane body, the base being simultaneously sized for two, three, and four tile configurations, the base to body coupling including a frangible breakaway section, the base and integral one piece, one plane body being integral prior to frangible separation, the frangible breakaway section, upon breaking, frangibly separating the integral one piece, one plane body from the base; and a wedge device comprising:

a backstop member, a first wedge member extending from the backstop member, the first wedge member having tapered surface penetrating the first window, a second wedge member extending from the backstop member, second wedge member having a tapered surface penetrating the second window, the second wedge member being laterally spaced from the first wedge member, and the backstop member, the first wedge member, and the second wedge member, in combination, being simultaneously sized for two, three, and four tile configurations.

2. The tile leveling device as recited in claim 1, wherein the integral one piece, one plane body further comprises a spacer extending transversely from the front and rear of the integral one piece body in a longitudinal plane aligned with the first and second windows, the spacer configured to position the first and second tiles a predetermined distance apart.

3. The tile leveling device as recited in claim 1, wherein the first wedge member further comprises teeth along the tapered surface, the teeth latch onto a first upper edge of the first window.

4. The tile leveling device as recited in claim 1, wherein the second wedge member further comprises teeth along the tapered surface, the teeth latch onto a second upper edge of the second window.

5. A tile leveling device comprising:

a leveling device comprising:

an integral one piece body defining first and second windows within the integral one piece body, the integral one piece body further comprises a spacer extending transversely from the front and rear of the integral one piece body in a longitudinal plane aligned with the first and second windows, the spacer configured to position the first and second tiles a predetermined distance apart;

a base coupled to the integral one piece body by a base to body coupling, the base extending to the front of the integral one piece body and the base extending to the rear of the integral one piece body, the base simultaneously being sized for two, three, and four tile configurations; and a wedge device comprising:

a backstop member, a first wedge member extending from the backstop member, the first wedge member having a tapered surface penetrating the first window, second wedge member extending from the backstop member, the second wedge member having a tapered surface penetrating the second window, the second wedge member being laterally spaced from the first wedge member, and the backstop member, the first wedge member, and the second wedge member, in combination, being simultaneously sized for two, three, and four tile configurations.

6. The tile leveling device as recited in claim 5, wherein the first wedge member further comprises teeth along the tapered surface, the teeth latch onto a first upper edge of the first window.

7. The tile leveling device as recited in claim 5, wherein the second wedge member further comprises teeth along the tapered surface, the teeth latch onto a second upper edge of the second window.

8. The tile leveling device as recited in claim 1, wherein the backstop member further comprises an oversized backstop member, the oversized backstop member extending laterally and vertically beyond the first wedge member and the second wedge member.

9. The tile leveling device as recited in claim 5, wherein the backstop member further comprises an oversized backstop member, the oversized backstop member extending laterally and vertically beyond the first wedge member and the second wedge member.

10. A tile leveling device comprising:

a leveling device comprising:

an integral one piece, one plane body defining first and second windows within the integral one piece, one plane body, a base coupled to the integral one piece, one plane body by a base to body coupling, the base extending to the front of the integral one piece, one plane body and the base extending to the rear of the integral one piece, one plane body, the integral one piece, one plane body intersecting the base perpendicularly in a single plane, the base to body coupling including a frangible breakaway section, the base to body coupling being in the single plane, the base and integral one piece, one plane body being integral prior to frangible separation, the frangible breakaway section, upon breaking, frangibly separating the integral one piece, one plane body from the base; and a wedge device comprising:

a backstop member, first wedge member extending from the backstop member, the first wedge member having tapered surface penetrating the first window, and a second wedge member extending from the backstop member, second wedge member having a tapered surface penetrating the second window, the second wedge member being laterally spaced from the first wedge member.

11. The tile leveling device as recited in claim 10, wherein the integral one piece body further comprises a spacer extending transversely from the front and rear of the integral one piece body in a longitudinal plane aligned with the first and second windows, the spacer configured to position the first and second tiles a predetermined distance apart.

12. The tile leveling device as recited in claim 10, wherein the first wedge member further comprises teeth along the tapered surface, the teeth latch onto a first upper edge of the first window.

13. The tile leveling device as recited in claim 10, wherein the second wedge member further comprises teeth along the tapered surface, the teeth latch onto a second upper edge of the second window.

14. The tile leveling device as recited in claim 1, wherein the first window is selected from the group consisting of open windows and closed windows.

15. The tile leveling device as recited in claim 1, wherein the second window is selected from the group consisting of open windows and closed windows.

16. The tile leveling device as recited in claim 5, wherein the first window is selected from the group consisting of open windows and closed windows.

17. The tile leveling device as recited in claim 5, wherein the second window is selected from the group consisting of open windows and closed windows.

18. The tile leveling device as recited in claim 10, wherein the first window is selected from the group consisting of open windows and closed windows.

19. The tile leveling device as recited in claim 10, wherein the second window is selected from the group consisting of open windows and closed windows.

* * * * *